US006244774B1

(12) United States Patent
Barosso et al.

(10) Patent No.: US 6,244,774 B1
(45) **Date of Patent: *Jun. 12, 2001**

(54) CAPILLARY WRITING MEDIUM RESERVOIR SYSTEM

(75) Inventors: Luigi Barosso, San Mauro (IT); Werner Lang, Weinheim (DE)

(73) Assignee: Merz & Krell GmbH & Co. KG (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/370,689

(22) Filed: Aug. 9, 1999

Related U.S. Application Data

(62) Division of application No. 08/432,151, filed on Jun. 1, 1995, now Pat. No. 6,027,271.

(30) Foreign Application Priority Data

Nov. 6, 1992 (DE) ..... 42 37 616

(51) Int. Cl.[7] ..... B43K 5/00
(52) U.S. Cl. ..... 401/198; 401/41; 401/42
(58) Field of Search ..... 401/40, 41, 199, 401/201, 198, 42

(56) References Cited

U.S. PATENT DOCUMENTS

| | | | |
|---|---|---|---|
| 620,216 | 2/1899 | Blair | 401/40 |
| 1,947,092 | 2/1934 | Kingman | 120/42 |
| 1,978,676 | 10/1934 | Kingman | 120/42 |
| 1,998,930 | 4/1935 | Kingman | 120/42 |
| 2,547,541 | 4/1951 | Rosenthal | 401/199 |
| 3,290,717 | 12/1966 | Mizutani | 15/563 |
| 3,481,677 | 12/1969 | Abrahamson | 401/198 |
| 3,993,409 | 11/1976 | Hart | 401/199 |
| 5,362,168 * | 11/1994 | Abe et al. | 401/199 |

FOREIGN PATENT DOCUMENTS

| | | |
|---|---|---|
| 85744 | 2/1921 | (AT) . |
| 269816 | 7/1950 | (CH) . |

(List continued on next page.)

OTHER PUBLICATIONS

"Physik", Bertelsmann Lexikon, Vom Atom zum Universum von Richard Knerr, 1995, pp. 294–297.

(List continued on next page.)

*Primary Examiner*—David J. Walczak
(74) *Attorney, Agent, or Firm*—Duane, Morris & Heckscher LLP

(57) ABSTRACT

A capillary writing medium colorant reservoir system for a writing instrument and process for producing the colorant reservoir. The main problem in such colorant reservoirs is the storage time. During this time, the writing capacity of new writing instruments declines since the walls of the writing instruments are, if only slightly, permeable to solvents. In the long run a stored writing instrument thus dries out and loses the major proportion of its original writing capacity. To this end, the invention has a colorant reservoir with an elongated reservoir body made of fibrous material. The reservoir body is surrounded by a sleeve which is permeable to liquids and gases and gives the reservoir body its shape. The reservoir stores colorant to produce liquid writing medium, the colorant being stored between the fibers of the fibrous material of the reservoir body in dry form. A single-part or multipart wick projects from either side of the reservoir body. A process for producing the colorant reservoir is also proposed, according to which the elongated capillary fibrous body is surrounded by a gas and liquid-permeable but liquid-proof film and the fibrous body thus surrounded is soaked in or with a colorant concentrate. The soaked fibrous body is drained off and dried. Then a single-part or multipart rod-like wick is introduced, the wick being longer than the elongated fibrous body.

9 Claims, 1 Drawing Sheet

FOREIGN PATENT DOCUMENTS

| | | | |
|---|---|---|---|
| 1250302 | 9/1967 | (DE) . | |
| 2124298 | 11/1972 | (DE) . | |
| 2424918 | 4/1975 | (DE) . | |
| 3642037 | 6/1988 | (DE) | 401/199 |
| 4104871 | 11/1992 | (DE) | 401/199 |
| 822542 | 12/1937 | (FR) . | |
| 1193795 | 5/1959 | (FR) | 401/199 |
| 859820 | 1/1961 | (GB) . | |
| 986411 | 3/1965 | (GB) . | |
| 593299 | 5/1959 | (IT) . | |
| WO9218339 | 10/1992 | (WO) . | |

OTHER PUBLICATIONS

"Naturwissenschaften und Technik", Brockhaus, 1983, pp. 35–36.

"Kapillarsysteme", Dr. Erich Manegold, 1955, pp. 20–23 & 58–59.

* cited by examiner

CAPILLARY WRITING MEDIUM RESERVOIR SYSTEM

CROSS REFERENCE TO RELATED APPLICATION

This is a division of U.S. patent application Ser. No. 08/432,151, filed Jun. 1, 1995, now U.S. Pat. No. 6,027,271.

BACKGROUND OF THE INVENTION

1. Field of the Invention

The inventions relate to a capillary reservoir system for writing medium for writing instruments such as fiber-tip pens, liners and markers, consisting of several individual reservoirs which contain fibrous material. An economical variant according to another proposal contains only one fibrous material reservoir. The invention also relates to a capillary reservoir for colorant—as one of the above-mentioned individual reservoirs—for use in the above-mentioned writing instruments. Finally a process for the production of said colorant reservoir is proposed.

2. Prior Art

Writing instruments are known in a great variety of shapes which contain a liquid writing medium. In such cases the writing medium supply chamber may consist of a refillable supply container or a replaceable cartridge. In the case of fiber-tip pens, a capillary reservoir, e.g. a tampon or a package of fibrous material is provided in the housing of the writing instrument which contains a predetermined supply of ready-to-use writing medium. This supply is assigned to it during manufacture and determines the operating life of the writing instrument (cf. U.S. Pat. No. 3,481,677). When the above-mentioned cartridges are used, then environmental protection problems arise since the waste products—usually plastic cartridges—must be disposed of.

If a built-in writing medium reservoir is provided in the writing instrument which stores a predetermined quantity of writing medium, this quantity is limited a priori. After the previously stored quantity of writing medium has been released the writing instrument is empty and—like the cartridges—must be disposed of. To this one may add the problem that the predetermined quantity of writing medium decreases as a function of age even if the writing instrument is not used, that is to say, when it is on the shelves of the retailers and wholesalers for shipping and sales.

A refillable capillary writing medium reservoir system has become accessible to the technical world from WO 92/18339. It discloses a front and rear reservoir but does not disclose a central individual reservoir which stores the color component contains fibrous material. A "marking or coloring pen" (marker) is described in U.S. Pat. No. 3,993,409 (Hart). In two examples there markers are described which display two individual reservoirs. They are telescoped into one another. One of the reservoirs is the writing tip (or the "writing wick"), the other is the liquid reservoir. The latter is clearly larger than the former. In Hart the individual reservoirs are arranged in one another not on one another, the size dimensions are also contrary to the object of the invention. To be sure the writing wick in Hart also stores the writing fluid and color pigments simultaneously.

U.S. Pat. No. 3,993,409 (Hart) discloses an elongated reservoir having fibrous material filled with a colorant for the production of liquid writing medium which is stored between the fibers, but not a shell permeable for liquid and gasses. Placing a shell around the wick of Hart would be equivalent to making the Hart marker function less which is based on the telescoping—in contact of the outside of the wick and the inner hole (boring) of the plug for its function.

SUMMARY OF THE INVENTION

It is objective of the invention(s) to give the above-mentioned writing instruments a longer operating life and especially a longer shelf life as well as to simplify the production of the reservoir system.

These problems are solved—independently of one another—by the technical ideas taught by the invention.

With respect to the capillary writing medium reservoir system for the above-mentioned writing instrument, the basic feature for the success of the invention is the dividing up of the previously single reservoir into a multiplicity of fibrous material reservoirs. In this case at least three reservoirs are provided, a rear reservoir, a front reservoir, and the individual reservoir between them. The latter stores the color component of the writing medium in dry form in fibrous material. This type of storage is timeless. With it a finished writing instrument can be stored for long periods without drying out and without losing its predetermined writing capacity, because the dry color component of the writing medium cannot dry out further and a liquid component which could escape through the walls or evaporate does not exist. Before the writing instrument is put into use, the rear individual reservoir is impregnated with a dissolving fluid from outside of the writing instrument. It may be water or alcohol. The filled-in dissolving fluid passes from the rear individual reservoir through the wick—connecting the individual reservoirs—to the central fibrous material colorant reservoir where the color component is drawn by capillary forces into the dissolving fluid in order via the wick to reach as a (colored) writing medium the front individual reservoir which is in contact with the writing point. The latter individual reservoir—which may be smaller than the other reservoirs—has the additional function of making the writing medium more uniform and of always storing a certain but limited quantity for immediate writing.

The capillary flow connection is the decisive concept according to the invention, because the consumption of writing medium from the front individual reservoir—due to the forces of equalization extending from the strongly moistened rear individual reservoir to the central individual reservoir—which mixes the colorant in—all the way to the self-emptying front individual reservoir leads to the automatic refilling of the front individual reservoir with writing medium.

The above-mentioned dividing up of the previously single reservoir into a multiplicity of reservoirs—without departing from the idea of the dry reservoir for colorant in a reservoir for coloring material—can be even further simplified in terms of cost. Thus the central and lower individual reservoirs can be brought together to form a continuous reservoir for colorant which stores both the dry colorant (the color pigment) and also—after the writing instrument is filled—the liquid writing medium. In this case only one additional reservoir (the rear individual reservoir) is necessary which is not filled with fibrous material but rather represents a hollow cavity or space. The liquid is poured into this hollow space where it is briefly stored (buffer space) in order to be added slowly to the colorant reservoir. At this time the writing medium is formed which can then be sent to the writing point—which is in connection with the colorant reservoir. While the rear buffer reservoir stores the poured—in dissolving fluid only briefly, i.e. until the writing medium reservoir has totally drawn it out, the latter stores the writing medium in liquid form for a very long time.

If a removable cap is provided for the writing instrument, then it is recommended that its volume be selected so as to be as large as that of the buffer reservoir. But since the colorant reservoir is much larger than the buffer reservoir, manufacture not only becomes less expensive because of the smaller number of reservoirs but the writing instrument thus formed is also provided with a much higher writing capacity A wick is not necessary, since it is not necessary to connect the multiplicity of individual fibrous material reservoirs.

Writing instruments with the capillary writing medium reservoir system described are therefore capable of unlimited storage, do not dry out during such storage and a user can be confident that when the writing instrument is first put into use its full writing capacity will be available—due to the writing medium content in the colorant reservoir.

The last—mentioned colorant reservoir—according to the invention—has an elongated reservoir body. This body is formed of fibrous material. It is surrounded by a shell which is permeable for liquid and gas and which gives the reservoir body its shape and holds it. The liquid writing medium is produced by mixing the colorant which is stored between the fibers of the fibrous material of the reservoir body in dry form. A single-part or multipart wick protrudes out of the reservoir body at both ends.

The success of the invention is supported here also by the storage of the pigment component in dry form. The elongated shape of the reservoir body permits a high storage capacity. The shell gives it shape stability and simplifies the manufacture of the writing instruments in which capillary colorant reservoirs are used. Both the high volume and the dry storage assure the initially postulated long operating life and permit long-term storage without a loss of capacity. The single-part or multipart wick may also contribute to this, by means of which the dissolving liquid is fed in, on the one hand, and through which the colorant—enriched dissolving fluid—the writing medium—is carried off from the colorant reservoir on the other. A single-part or multipart wick is possible because of the capillary flow connection. If a single-part—therefore permeable—wick is selected then the dissolving fluid while passing through the wick absorbs the colorant from the reservoir. At the same time the dissolving fluid also leaves the wick and passes into the colorant reservoir and is distributed along the fibers located there and emerges through the wick at the opposite end. For the latter case a division of the wick into two, upper and lower, partial wicks is possible.

Since a flow connection is not necessary between the several reservoirs—in one embodiment, a wick may be omitted there. In another embodiment the colorant reservoir, which simultaneously becomes a writing medium reservoir, is advantageously enlarged, especially to twice the size of the rear refillable individual reservoir. A further lengthening of the colorant reservoir/writing medium reservoir is also conceivable except for a very short rear liquid buffer.

Along its entire extent the colorant reservoir/writing medium reservoir can also be surrounded by a shape-preserving shell.

The shell may consist of a porous film of moisture-proof material. If a moisture-proof and slightly water—and gas-permeable film is used such as polypropylene, then the film may be perforated, which produces the porosity. The advantage of the porosity—through the gas and moisture permeability or the holes provided for this—is venting to the outside upon the impregnation of this colorant reservoir. During refilling the core of the fibrous material of the colorant reservoir can be sucked full and swell up. The fibers have room to swell into the holes provided in the film circumscribing the outer dimensions. If the filled colorant reservoir is then dried, then the evaporating gas from the dissolving fluid can easily escape through the porous film. In this way the color pigments remain in the colorant reservoir. Because of the porosity almost total drying of the colorant reservoir is assured. The dry color depot (the colorant reservoir) retains its high capacity for colorant or color pigments in this way.

The capillary wick which may be inserted into the colorant reservoir may have the thickness of a pin or knitting needle. It is of greater strength than the fibrous material of the colorant reservoir surrounding the shell. Wicks of extruded material may also be used which are generally used for the tips of fiber-tip pens. The capillary wick may be pointed on one or both ends. It can also be of several parts. However, a continuous wick is simpler to produce which penetrates the colorant reservoir over its entire length. At both ends of the elongated colorant reservoir then a small part of the long capillary wick protrudes. The protruding segments form the connection with the other reservoirs arranged on both sides of the colorant reservoir.

Finally a process for the production of the capillary colorant reservoir in accordance with the invention is essential.

According to the four basic process steps an elongated capillary fibrous body is surrounded with a gas-permeable and liquid-permeable film. However, it is liquid proof. The thus jacketed fibrous body becomes impregnated with a color concentrate which is accomplished by inserting the fibrous body into the concentrate or by introducing the concentrate into the fibrous body. Then the impregnated fibrous body is allowed to drip dry and then dried. The single-part or multipart rod-shaped wick which may be inserted into the fibrous body has a length which is greater than the longitudinal dimension of the fibrous body. The wick may be inserted into the fibrous body after drying but it can also be inserted after drip drying—before drying—or this can be done before impregnation.

If the colorant reservoir is produced by the process described, then it has the required high storage capacity for colorant while its production in large series is simultaneously more economical. During the process steps described it may be stored in wire boxes, in which case the containers may have a high holding capacity—therefore contain a large number of color depots.

Multiple impregnations will increase the concentration of the pigment in the colorant reservoir. Of advantage here is a concentrated coloring solution—produced from color pigments and a solvent, e.g. based on water or alcohol. Other solvents may also be used. The more strongly the dry colorant reservoir is dried, the higher the color concentration may be and the more favorable are the long-term storage conditions. Therefore a two-step drying process may be envisioned. According to this the drip-dried colorant reservoir is first dried in air and then secondarily or finally dried in an oven. The oven drying may take place under vacuum conditions, thus achieving an accelerated expulsion of all solvents.

BRIEF DESCRIPTION OF THE DRAWINGS

The invention is made more understandable by examples of its embodiment.

DETAILED DESCRIPTION OF THE PREFERRED EMBODIMENTS

Figure 1:
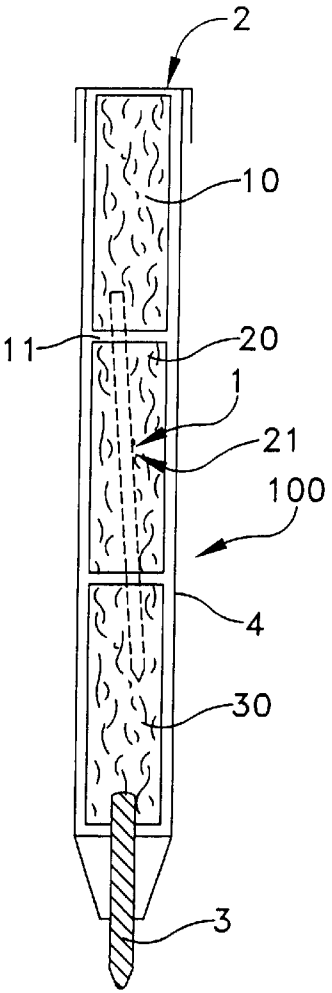
FIG. 1 shows schematically a section through a writing instrument with three individual reservoirs 10, 20, 30.

FIG. 1 illustrates a section through a fiber-tip pen. At the lower end of the fiber-tip pen 100 is a point 3 which may be made from an extruded material. At the upper end is a screw-off or removable cap 2 through which the underlying first individual buffer reservoir 10 (rear individual reservoir) can be supplied with dissolving fluid. Under it lies the central colorant reservoir 20 which stores the colorant in dry form. It is followed by the individual reservoir 30 (front individual reservoir) for the finished writing medium, with the writing point 3 from the tip of the writing instrument 100 sticking into it.

The three consecutive individual reservoirs 10, 20, 30, are enclosed in a housing 4 which forms the jacket of the writing instrument 100. A zone 11 may be provided between the first individual reservoir 10 and the central reservoir 20 to impede a direct flow to the writing tip and to throttle the flow of fluid from the first reservoir 10 to the central reservoir 20. In the longitudinal direction said three individual reservoirs are connected to one another by a wick 1. It may be positioned centrally and in the central axis of the three reservoirs but it may also pass obliquely through the colorant reservoir 20 and terminate correspondingly in the individual reservoirs 10, 30, arranged on both sides.

Depending on what form the writing instrument 100 has, the jacket 4 is round, square, or triangular in shape. This jacket shape is also displayed by the individual reservoirs 10, 20, 30, which then may also be round, square, or triangular in shape.

However, the round shape is advantageous so that all three individual reservoirs 10, 20, 30, have a cylindrical shape. As regards the length of the individual reservoirs, depending on the writing capacity and the colorant selected, various measures may be taken. If a high coloring capacity is required, then the central colorant reservoir 20 has priority and occupies a high percentage of the available internal space of the jacket 4. The storage for the liquid in the liquid—reservoir 10 is less critical. It can be refilled optionally and therefore need not have a high capacity. The capacity of the writing medium reservoir 30 may also be small, since it is supplied continuously from the colorant reservoir 20 and the liquid reservoir 10 above it.

To construct the individual reservoirs here we shall refer only to the fibrous materials of the colorant reservoir 20 which are designated by 21. The filling may be any type of fiber material, advantageously cellulose acetate or polyester.

Figure 2:
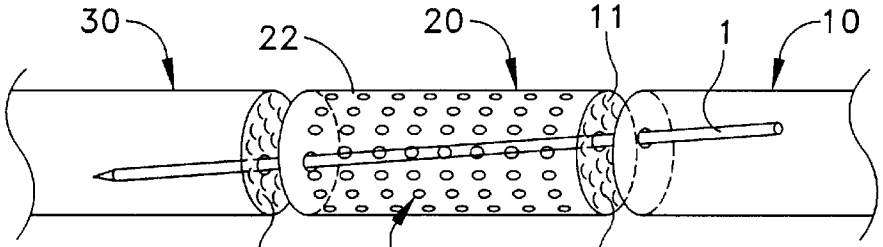
FIG. 2 shows in perspective the consecutive arrangement of the three individual reservoirs 10, 20, 30, where the central individual reservoir 20—the dry colorant reservoir—is emphasized.

FIG. 2 provides more details on the representation shown in FIG. 1 by giving a perspective view of the possible cylindrical individual reservoirs. All three reservoirs 10, 20, 30, are connected to one another via the wick 1. A zone 11 is provided between the first individual reservoir 10 and the central reservoir 20, which impedes a direct flow to the writing tip and throttles the flow of fluid from the first reservoir 10 to the central reservoir 20. Originally the wick 1 was first pushed only through the colorant reservoir 20 so that the end of the wick 1 would protrude on both end sides of the colorant reservoir 20. These ends are then pushed into the other reservoirs 10, 30. With this a capillary flow connection exists between the reservoir 10 and the writing medium reservoir 30 at whose end the above-mentioned fiber tip 3 releases the writing medium onto the paper of the user.

The fibrous material 21 and 31 fills the reservoirs 20 and 30, the same pertains also to the filling of the reservoir 10. Here we shall emphasize the colorant reservoir 20. It has a shell 22—as shown in cross section in FIG. 3—which preserves its shape. In the shell are a large number of perforations 23 which permit the liquid in the filling of fibrous material of the reservoir 20 to enter—during impregnation of the reservoir. At the same time the perforation 23 of the shell 22 permits the fibers of the fibrous material to emerge during impregnation due to swelling. It then acquires the shape shown schematically in FIG. 3 where the fibers emerge from the perforations 23 because of the swelling of the packing but simultaneously are held as a bundle in the openings. If the colorant reservoir 20 then is dried—after impregnation and drip drying—then the perforations 23 form an outstanding uniform exit possibility for the gases forming from the solvent with which the color pigments pass into the colorant reservoir.

A precondition for the shell 22 is only that it must be liquid proof, therefore stable. Along with stability it should also have porosity which serves the above-mentioned functions. Porosity means, on the one hand, that openings are provided when the film used for the shell 22 is gas—and/or water-impermeable. Porous, however, also means that a gas and water-permeable film may be used. Likewise a combination can be selected of gas—and moisture-permeable film in which additional perforations 23 are made.

The arrangement of the perforations 23 may be symmetrical but it is not absolutely required, and any arbitrary distribution over the surface of the colorant reservoir 20 is possible.

Figure 3:
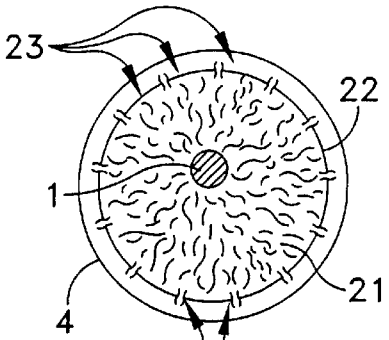
FIG. 3 shows a horizontal section to the above-mentioned central colorant reservoir 20 in which the wick 1 is visible.

FIG. 3 has already been mentioned. In it one sees a section through the colorant reservoir 20. The wick 1 is situated centrally in the fibrous material 21 which forms the core of the colorant reservoir 20. The bundles of fibrous material emerging from the perforations 23 are the result of the intensive impregnation process where the fiber bundles which emerge after drying no longer withdraw totally into the cylindrical shape of the colorant reservoir 22.

As regards the wick 1 it may be remarked that the latter is represented as a continuous wick 1 but may also be selected to have an interrupted configuration. In this case two wick parts are pushed into the colorant reservoir 20 at both ends in order to create a connection with the adjacent reservoirs 10, 30. A connection running internally in the colorant reservoir 20 is not absolutely necessary, because the fibrous material also has capillary action and drives the dissolving fluid out of the individual reservoir 10—while enriching it with color pigments—to the writing medium reservoir 30 via the lower wick part.

We shall describe—without drawings—a process by which colorant reservoir 20 or pigment cartridges can be produced. One starts with a concentrated color solution which is produced on a water or alcohol base. The solvent should be highly volatile, therefore water or ethanol are especially suitable. At the same time, however, it should display sufficient dissolving capacity in order to bind at least 10% of the pigments in the solution.

A suitable fibrous material for the colorant reservoir 20 is cellulose acetate or polyester, but other fibrous materials may also be tried. Cellulose acetate or polyester is roughly brought into shape and then surrounded by a permeable and/or perforated shell. It permits entrance of the dissolving liquid with the color pigments and assures an easy exit of the gases forming during drying.

First the fiber material cartridge surrounded by the shell is saturated with the above-mentioned color solution. For this purpose it is immersed in it. Following this it can be removed from the color solution and drip-dried. This can be accelerated by exposure to mechanical forces.

After drip-drying the colorant reservoir 20 are thoroughly dried. This drying process may take place in one or two steps, in particular a two-step drying has proven effective where first an air-drying process takes place followed by an oven-drying process. One to two hours are sufficient essentially to complete the air drying. After this, depending on the capacity and temperature—the oven-drying process follows for which a vacuum oven has proven especially effective since the time can be shortened in this way.

The drying process is followed by an individualization process in which the colorant reservoirs 20 are shaken in order to separate them from one another. The use of this step depends on how the colorant reservoir 20 is saturated, drip-dried and dried; if they are stored in baskets during said procedure which can hold a multiplicity of colorant reservoirs, then the shaking process is necessary to separate the cartridges. On the other hand, if impregnation, drip-drying and drying are performed in such a way that the cartridges already pass through these process steps individually, then the shaking process is no longer necessary.

The production of the colorant reservoir 20 is concluded by inserting a wick or rod 1 through the colorant reservoir 20, depending on length, which protrudes from both ends. The wick 1 may be pointed at one or both ends, and consist of extruded material, as in the case of the fiber tips 3 shown in FIG. 1. With regard to strength it is only important that it must be greater than that of the fibrous material 21 held together by the shell 22, because the wick 1 must penetrate it mechanically.

FIG. 2 shows an example of a continuous throughgoing wick 1 which can be especially simply pushed into the cartridge in order during its fabrication. However, a two-part rod may also be used for this purpose which is inserted into the colorant reservoir 20 on both sides. The connection between the ends located in the colorant reservoir is then made along the fibrous material in the direction in which the dissolving fluid absorbs the colorant.

The porosity of the shell 22 of the colorant reservoir 20 is enhanced by the fact that the perforations 23 may be present before completion of the elongated cylindrical shaping in the film but it can also be inserted into the colorant reservoir 20 after an unperforated smooth film has been applied. This can be done in a rolling process between two plates provided with mandrels between which simultaneously a multiplicity of colorant reservoirs 20 are provided with perforations 23 which are supposed to accelerate the impregnation process and simultaneously offer the gas formed during drying a simple way to escape.

Figure 4:
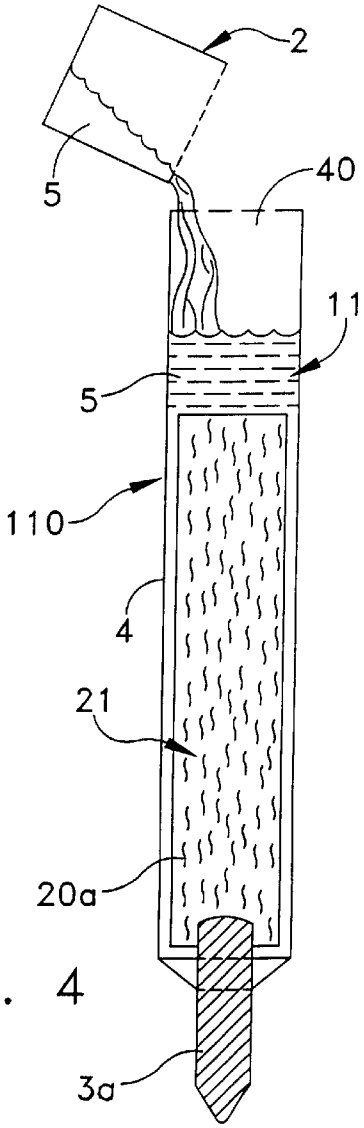
FIG. 4 shows a marker which has only one (enlarged) colorant reservoir 20*a*.

FIG. 4 shows a marker 110. Its writing tip 3*a* is thicker than the writing tip 3 of the pen shown in FIG. 1, which may be a liner or fiber-tip pen. It also has the jacket 4 which forms the grasping cylinder of the pen. While the tip is arranged at the bottom of the writing end of the cylindrical pen, it is open at the top. This opening may be closed by a cap 2; the cap 2 is shown while filling dissolving fluid into the upper reservoir 40. There the introduced fluid collects temporarily—only briefly—in order then to penetrate into the enlarged colorant reservoir 20*a*—with cellulose packing 21. A zone 11 is provided the between the upper reservoir 40 and the colorant reservoir 20*a*, which impedes a direct flow to the writing tip and throttles the flow of fluid to the colorant reservoir 20*a*. There it dissolves the dry stored color pigments and forms the writing medium for the writing tip 3*a* in liquid form.

This design has special cost advantages, because now only a single writing medium reservoir/color component reservoir is necessary. The upper liquid reservoir 40 serves to buffer a certain quantity of—dissolving fluid supplied by the cap 2, since the latter cannot be drawn into the enlarged colorant reservoir 20*a* very rapidly. Several capfuls may also be needed in order to fill or to refresh the liquid writing medium in the enlarged colorant reservoir 20*a*.

Thus the zone 11 between the upper reservoir 40 containing the fluid 5 and the enlarged colorant reservoir 20*a* with cellulose packaging 21 forms a section which provides for temporarily storing the liquid in the buffer reservoir above a back end of the intermediate reservoir 20*a* with cellulose packaging 21. The flow of the fluid 5 is inherently impeded to flow directly to the writing tip 3*a*. The flow is throttled from the buffer storage to the intermediate reservoir. Having arrived in the intermediate reservoir, the fluid serves for dissolving the dry color component stored there.

The enlarged colorant reservoir 20*a* as shown in FIG. 4 has cellulose packaging 21. The writing tip 3*a* is thicker, but shorter than the related writing tip 3 shown in FIG. 1. It has a front end and a back end. The back end of the thicker writing tip 3*a* of FIG. 4 having a distance from the back end of the enlarged colorant reservoir 20*a*, which is about the same distance it has from the front end of the buffer reservoir 40. The distance is substantially larger than the length of the writing tip 3*a* of FIG. 4.

The economical production due to the omission of the wick, the manufacturing step involving it, and because of the simplified assembly, has already been mentioned. However, one should also mention the possibly higher writing capacity, because enlarged colorant reservoir 20*a* can store a larger number of color pigments. Here the writing medium reservoir 20*a* in dry form can even be selected so large that the upper reservoir 40 for the liquid is only very small. Then liquid must be poured in with the cap 2 several times in order to form the writing medium.

The advantage here is also the fact that refilling (refreshing) of the writing capacity can be done in an extremely well measured way, because only small quantities are added. On the other hand, if a larger upper reservoir is used, the risk exists that excessive refreshing will take place and the writing medium will become too strongly diluted.

What is claimed is:

1. Capillary writing medium reservoir system for a writing instrument, said system comprising:

a rear individual reservoir;

an intermediate elongated individual reservoir; and a front individual reservoir, in serial relationship, the intermediate and front individual reservoirs contain fibrous material operable to support capillary action, (a) the rear individual reservoir being arranged to be filled from the outside of the writing instrument with a fluid which the rear reservoir stores for a limited time;

(b) the front individual reservoir being arranged to communicate with a writing tip of the writing instrument for which the front individual reservoir temporarily stores writing medium, and, (c) the intermediate elongated individual reservoir storing a color component in dry form within the fibrous material for the production of writing medium, stored in the individual reservoir as well.

2. Writing instrument having a writing medium storage system, comprising:

a rear buffer reservoir; and an intermediate individual reservoir in serial relationship, said intermediate individual reservoir having a volume and containing substantially throughout said volume fibrous material, operable to support capillary action, wherein, (i) the rear buffer reservoir is arranged to be filled from the outside of the writing instrument with a dissolving fluid which the rear buffer reservoir stores for a limited time;

(ii) the fibrous material reservoir being arranged to store a color component in dry form and a liquid writing medium produced therefrom in liquid form, and which the fibrous material reservoir is arranged to communicate with a writing tip for which the fibrous material reservoir stores the liquid writing medium, the writing tip storing no color component prior to the filling with the dissolving fluid; and (iii) the writing medium storage system is arranged such that the liquid writing medium is stored and available in the fibrous material reservoir when the dissolving fluid is filled into the rear buffer reservoir, and then after the limited storage time migrates into the fibrous material reservoir to be stored there for a substantial time to supply the writing tip for purposes of writing.

3. Writing instrument having a writing tip, and a writing medium storage system, comprising:

a rear buffer reservoir;

an intermediate individual reservoir containing a fibrous material operable to support capillary action substantially throughout an extension thereof, said intermediate reservoir being disposed between the rear buffer reservoir and the writing tip;

a shell which is permeable for liquids and gases and which gives the intermediate reservoir its shape; and colorant for producing a writing medium, which colorant is stored between the fibers of the material in the intermediate reservoir in dry form, the rear buffer reservoir and the intermediate individual reservoir being in serial relationship, wherein, (i) the rear buffer reservoir is arranged to be filled from the outside of the writing instrument with a dissolving fluid which the rear buffer reservoir stores for a limited time;

(ii) the intermediate individual reservoir being arranged to store a color component in dry form and a liquid writing medium produced therefrom in liquid form, and which individual reservoir is arranged to communicate with the writing tip for which the individual reservoir stores the liquid writing medium, the writing tip storing no color component prior to the filling with the dissolving fluid; and (iii) the writing medium storage system is arranged such that the liquid writing medium is stored and available in the intermediate individual reservoir when the dissolving fluid is filled into the rear buffer reservoir, and then after the limited storage time migrates into the intermediate individual reservoir to be stored there for a substantial time to supply the writing tip for purposes of writing.

4. Writing instrument in accordance with claim 3, wherein the shell consists of a porous film of moisture-proof film selected from the group consisting of a polypropylene film, a perforated film, a permeable film and a perforated and permeable film.

5. Writing instrument according to claim 2, the writing tip having a length and the instrument having a distance between a back end of the writing tip and a front end of the buffer reservoir, said distance being substantially larger than the length of the writing tip.

6. Writing instrument according to claim 5, wherein the fibrous material reservoir is disposed along the distance for providing higher writing capacity and an enlarged colorant reservoir.

7. Writing instrument according to claim 2, having a zone between the buffer reservoir temporarily storing the liquid and a back end of the intermediate reservoir, impeding a direct flow to the writing tip and throttling the flow of the fluid from the buffer storage into the intermediate reservoir and thereby dissolving the dry color component stored there.

8. Reservoir system in accordance with claim 1, wherein a wick having at least one part protrudes out of the intermediate reservoir on both sides.

9. Reservoir system in accordance with claim 1, which, (a) has a capillary wick that is of greater strength than the fibrous material in the individual reservoir, said reservoir having two ends and a length and, (b) is pierced by the capillary wick over the entire length of the intermediate reservoir;

(c) wherein said wick protrudes from both ends of the intermediate reservoir.

* * * * *